US007442077B2

(12) United States Patent
Peress et al.

(10) Patent No.: US 7,442,077 B2
(45) Date of Patent: Oct. 28, 2008

(54) MODULAR CABLE SYSTEM FOR SOLAR POWER SOURCES

(75) Inventors: Sass M. Peress, Montreal (CA); Po K. Lau, Outremont (CA)

(73) Assignee: ICP Global Technologies, Inc. (CA)

( * ) Notice: Subject to any disclaimer, the term of this patent is extended or adjusted under 35 U.S.C. 154(b) by 702 days.

(21) Appl. No.: 10/710,077

(22) Filed: Jun. 17, 2004

(65) Prior Publication Data

US 2005/0032416 A1 Feb. 10, 2005

Related U.S. Application Data

(60) Provisional application No. 60/479,050, filed on Jun. 17, 2003.

(51) Int. Cl.
*H01R 13/44* (2006.01)

(52) U.S. Cl. ..... 439/505; 439/468; 439/135

(58) Field of Classification Search ..... 439/502, 439/505, 488, 135, 483, 504, 491, 498, 136, 439/149

See application file for complete search history.

(56) References Cited

U.S. PATENT DOCUMENTS 4,150,866 A 4/1979 Snyder, Jr. et al.
4,310,211 A 1/1982 Bunnell et al.
5,232,518 A 8/1993 Nath et al.
5,268,038 A 12/1993 Riermeier et al.
5,984,716 A * 11/1999 Starkey ..... 439/488
5,990,414 A 11/1999 Posnansky
6,147,471 A 11/2000 Hunter
6,247,956 B1 6/2001 Porter, Jr.
6,268,559 B1 7/2001 Yamawaki
6,398,579 B1 6/2002 Banas et al.
6,617,822 B1 9/2003 Kirkpatrick
6,650,085 B2 11/2003 Lau et al.
6,671,612 B2 * 12/2003 Fuse ..... 701/112
6,736,682 B1 5/2004 Groebmair et al.
6,842,727 B1 * 1/2005 Hayashi ..... 703/18
7,226,300 B2 * 6/2007 Khemakhem ..... 439/135

* cited by examiner

*Primary Examiner*—Gary F. Paumen
(74) *Attorney, Agent, or Firm*—Nelligan O'Brien Payne LLP; Wing T. Yan

(57) ABSTRACT

A modular system of mating connector cables for connecting solar power sources to devices requiring power includes connector cables assembled from compatible cable segments, mating connectors and junctions. The cables of the system may be of consistent polarity among various configurations such that current flows through mating connectors at the cable ends. The cables may be variously configured to provide for the connection of solar power sources in series or in parallel, and for connection to devices with various power input connectors or terminals.

12 Claims, 5 Drawing Sheets

MODULAR CABLE SYSTEM FOR SOLAR POWER SOURCES

CROSS REFERENCE TO RELATED APPLICATIONS

This application claims the benefit of U.S. Provisional Application Ser. No. 60/479,050 filed Jun. 17, 2003.

BACKGROUND OF INVENTION

Field of the Invention

This invention generally relates to the connection and use of solar panels, and, more particularly, to a modular series of cables for use in connecting one or more solar panels in various applications.

In recent years, the use of solar panels for harnessing and applying the energy of the sun has greatly expanded. New technologies have increased the versatility of solar panels, thus widening the scope of their application. For example, solar panels are increasingly capable of powering devices such as vehicle battery chargers, radios, computers, and other personal electronic devices. Some of these devices may rely primarily on battery power, and are thus subject to the inherent limitations of batteries such as weight, limited charge, and the inability to provide variable current or voltage to meet changes in power demand.

A contemporaneous trend is the increase in power requirements of such devices. In addition to higher average power draw, such devices often require short-term or sudden increases in power. For example, a battery charger may draw a higher power on average to recharge newer high-power batteries, or to recharge them in a shorter time. In addition, certain computer equipment may require short-term or sudden increases in power, such as when a backlit monitor is required, or when a disk drive is heavily used. Additionally, multiple connections of different source and load configurations may be required to power a range of devices. For example, it may be necessary to increase or decrease the voltage, current and wattage or the system, based on the generally increased and potentially variable power needs of particular devices. This may require adding or removing solar panels from a circuit, or changing the length of connection cable so that the solar panels may remain exposed to sunlight while a device is used in a low-sunlight environment. A flexible, modular system for providing solar power that provides this flexibility would be particularly advantageous if likewise configured for use outdoors, in various weather environments.

Many electrically powered devices, such as those described above, appeal to and are marketed to consumers, rather than businesses. To increase the convenience and range of use of such devices, they may be configured to be solely or optionally powered by solar energy. As consumers" prior knowledge and understanding of electrical circuitry cannot be presumed, it would be advantageous to provide an efficient, easy to use system for safely providing solar power to such devices. By minimizing the opportunities for errors such as improper connections and short-circuits, a connection system would become particularly appealing to consumers. It would also be advantageous to provide such a system that may be configured and reconfigured without the use of tools. The ease of use of such a "plug-and-play" system would appeal to a wide range of consumers.

Thus, a modular connection system that provides the aforementioned advantages is particularly useful and desirable. It would be further advantageous to provide such a system that facilitates tight mechanical and electrical connections, and is impervious to water and other adverse environments.

SUMMARY OF INVENTION

The invention provides a modular system for powering devices with solar energy by facilitating the interconnections between solar panels and the powered devices. The modularity of this system provides for a wide range of configurations based on a limited number of component parts.

The invention is generally directed to a modular system of electrically-conductive cables for the connection of a power source that derives electrical current from solar energy, such as a solar panel, to a device requiring electrical power. The system provides for cables of varying length and utility to include components selected and combined from a basic set. The components may include lengths of cable, various types of power jacks, and mutually compatible connectors or plugs, among others. Various embodiments of mutually compatible cables may thus be configured according to this invention, corresponding to various uses. The cables advantageously provide for various "plug-and-play" interconnections between devices and solar energy sources such as solar panels, thus facilitating use of the cables by persons lacking prior knowledge and understanding of electrical circuitry.

To provide for mutual compatibility and connectivity among various embodiments, the cables preferably include mating plugs. These plugs may be configured to interconnect tightly with each other, to facilitate state-of-the-art secure mechanical and electrical connections that may also be hermetically sealed or watertight. To ensure the safety of plugs that are not in use, particularly when a cable embodiment includes more than one input or output, the plugs preferably include caps that likewise provide a watertight seal. These caps prevent the intrusion of water, dust, and other harmful or corrosive substances, and may be permanently attached toward the end of the cable, near the connector plug, to prevent loss. In addition, the plugs may be configured to provide for quick connection and disconnection without the use of tools.

Each connector may also include a ribbed construction at its base that encircles the end of the cable attached to the connector. This ribbed construction strengthens the cable to connector joint and reduces the strain on the cable when it is bent at the connector base. This ribbed construction also provides a secure finger-gripping surface, particularly after it has been in contact with slippery substances, such as oil.

The system also provides for a high degree of safety. Specifically, the plugs may incorporate various safety features such as male-female plug construction, color coding, and molded or embossed universal symbols to designate power inputs and outputs, thus preventing the shorting of positive and negative leads together. For example, male-female construction may prevent the interconnection of two power outputs or two power inputs. Further, color-coding, or embossing the plugs with universal polarity or male/female symbols may provide the user of the system with visual and tactile cues that prevent improper connectivity.

The versatility of interconnection among various embodiments of the invention facilitates multiple connections of different source and load configurations. For example, in one embodiment, a first end of a cable may be fixed, or "hard-wired" to a solar panel. The second end of the cable may include an output plug that is connectable to the matching plug of a device requiring power, either directly or indirectly, through another cable embodiment of the present invention.

To provide for varying power loads of the device or devices, the cable may also include a junction from which a cable extension may extend. The cable extension may be configured to include a plug for connection from another solar power source, such as a solar panel, that includes a mating plug. In this way, current from both power sources can flow to a cable output plug and, subsequently, to a device. This type of connection allows separate solar power sources to be connected in parallel, such that the sum of the individual panels" currents is available through either of the remaining plugs. In this fashion, separate panels may be added in parallel, up to a maximum current limit allowed by the parameters of the cable and connectors used. Modular parallel connection as described in connection with this embodiment thus allows greater current output for a constant voltage range.

In another embodiment, a length of cable may include a junction at one end, from which extend two leads, each including a female modular connector plugs at its end. The female connector plugs of this embodiment may be configured with inverted leads. This configuration allows the serial connection of solar panels with mating connectors That is, two panels, each including a mating plug may thus be connected to the female plugs. The other end of the length of cable may include a male modular connector plug as the output. According to this embodiment, the sum of the individual panels" voltages is transmitted to the male plug of this cable, up to a maximum recommended voltage based on the parameters of the cable used.

In another embodiment, a cable may be provided that includes a modular input plug on one end, and a standardized power output for a user appliance with a matching input. In this embodiment, the modular plug may be a power input that is to be connected to mating power outputs of other devices or cables. The cable of this embodiment receives a power input such that the standardized power output becomes energized, and able to provide current to a device. Devices with inputs that mate with the standardized power output can thus be attached and energized. Standardized power outputs may include a female cigarette lighter adapter plug (CLA), among others. This type of configuration may be used to provide power to common 12-volt devices such as inverters and chargers for other consumer electronic devices.

Alternately, in another embodiment, a cable may be configured with a modular input plug on one end and a standardized power output at the opposite end, such as a pair of bared ring connectors, for connection to a battery. In this way the modular connection input plug, of the type described above, may be connected to a power source, while the standardized power output in the form of the pair of bared rings may be connected to an appropriately configured device requiring power.

Still another embodiment allows the configuration of a splitter cable, using the modular components. That is, a length of cable may include a single female power input connector plug on one end, to receive the male output plug of a single solar power source, or a plurality of such sources connected in series or parallel. The other end of the cable may include two or more male power output connector plugs attached to cable lengths extending from a cable junction. Each of the male output plugs may be connected to a device, thus allowing for the connection of two or more separate loads simultaneously to one or more solar power sources connected in series or parallel.

The system of the present invention may also be configured to fashion an extension cable with a power input plug attached to one end of a cable, and a mating power output plug attached to the other end. This is particularly advantageous where, for example, the single or combined solar power source is exposed to solar energy and the device requiring power is in use where there is little or no solar energy available. The mating plugs at the ends ensure the proper polarity when the cable is connected between the output of a single or combined solar power source and the input of a device requiring power. Additionally, more than one of the cables of this embodiment may be connected in series to create a longer extension. The cable length of this or any other embodiment is not limited to any particular length, but may be determined based on operational parameters and spacing between a single or combined power source and one or more devices.

Thus, the invention provides a flexible, modular system that may be utilized to provide solar power of various applications requiring different voltages, currents, or wattages with ease. The standardized "plug-and-play" type arrangement is easy to use and does not require specialized tools. It provides a high degree of safety with tightly bonded state of the art mechanical and electrical connections that are watertight, allowing the arrangement to be utilized both indoors and outdoors, and in various weather environments. Connections are hermetically sealed once the plugs are joined, minimizing or eliminating any danger of liquid infiltration, which could cause degradation, corrosion or eventual short circuits. Moreover, because the modular arrangement utilizes only standardized male and female plugs, it is practically impossible to short the positive and negative leads together, likewise minimizing or eliminating any possibility of short circuits. It will be appreciated, however, that the modular arrangement may be configured with the standardized female plugs as the input and the standardized male plugs as the output, or, alternately but preferably not simultaneously, with the standardized male plugs as the input and the standardized female plugs as the output, so long as the entire modular system is consistently configured.

This modular, standardized arrangement also provides for increased manufacturing efficiency. Providing various configurations and embodiments of a product from a basic stock of component parts reduces purchasing and sourcing costs, and facilitates assembly, as the number of possible assembly configurations between components decreases.

These and other advantages of the present invention, as well as additional inventive features, will be apparent from the description of the invention provided herein. Further features and advantages of the present invention, as well as the structure and operation of various embodiments of the present invention, are described in detail below with respect to the accompanying drawings. In the drawings, like reference numerals indicate identical or functionally similar elements.

DETAILED DESCRIPTION

The present invention is directed to a modular system for connecting a source of solar-generated electrical current to one or more devices requiring electrical power. The source of solar-generated electrical current may include one or more solar panels connected by an embodiment of the invention, in series or in parallel. The invention provides for the quick, convenient interconnection of the components of the solar power source and the devices requiring power, via modular connector cables. As shown in FIGS. 1, 3, 4, and 6-9, the system may include any number of a plurality of differently configured wire and plug connections. Such a connector cable may include a combination of elements including electrically-conductive cable segments, male and female mating connectors, universal-type connectors, wires, and one or more junctions.

Figure 1:
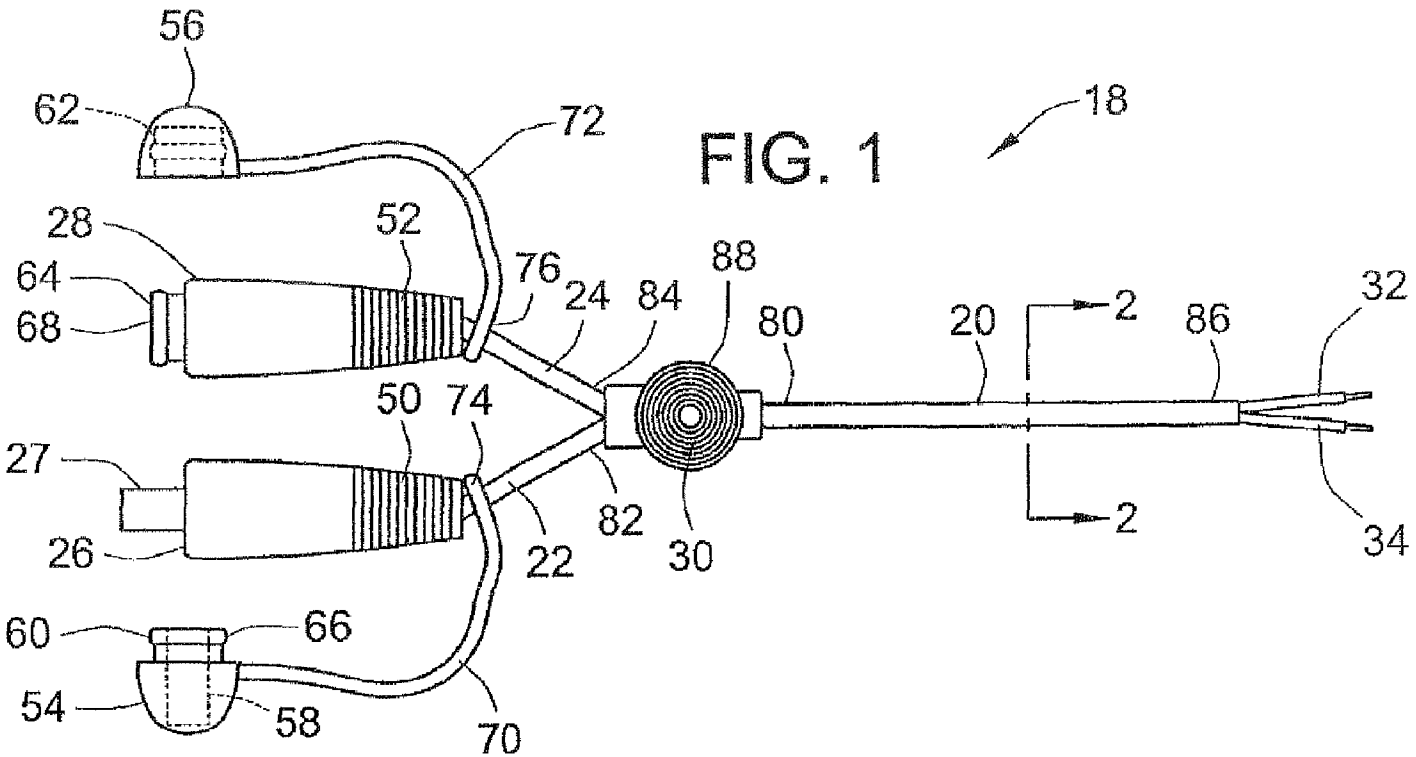
FIG. 1 is a plan view of an embodiment of a modular connection cable of a solar panel connection system constructed in accordance with teachings of the invention, the cable of this embodiment being provided for direct connection to a solar panel.

Turning first to FIG. 1, there is shown a connector cable 18 configured for connection to the photovoltaic power source or solar panel at wires 32, 34 and to provide a standardized output arrangement at male and female connector plugs 26, 28. The connector cable 18 of this embodiment may be configured such that each cable segment 20, 22, 24, extends from ajunction 30, terminating at the male connector plug 26, the female connector plug 28, and the wires 32, 34. Each cable segment 20, 22, 24 of the connector cable 18 may also include one or more insulated wires 32, 34 inside an insulating sheath 36, as illustrated, for example, in the sectional view of FIG. 2. In a particular embodiment of the invention, the insulated wires 32, 34 may be specified as AWG #16, although other wire gauges may be utilized, without deviating from the inventive scope. Additionally, the insulated wires 32, 34 may be specified as having a particular resistance to ultraviolet radiation, heat, or fire. They may also be rated for particular maximum voltage and current, as well as current type (AC/DC).

Figure 3:
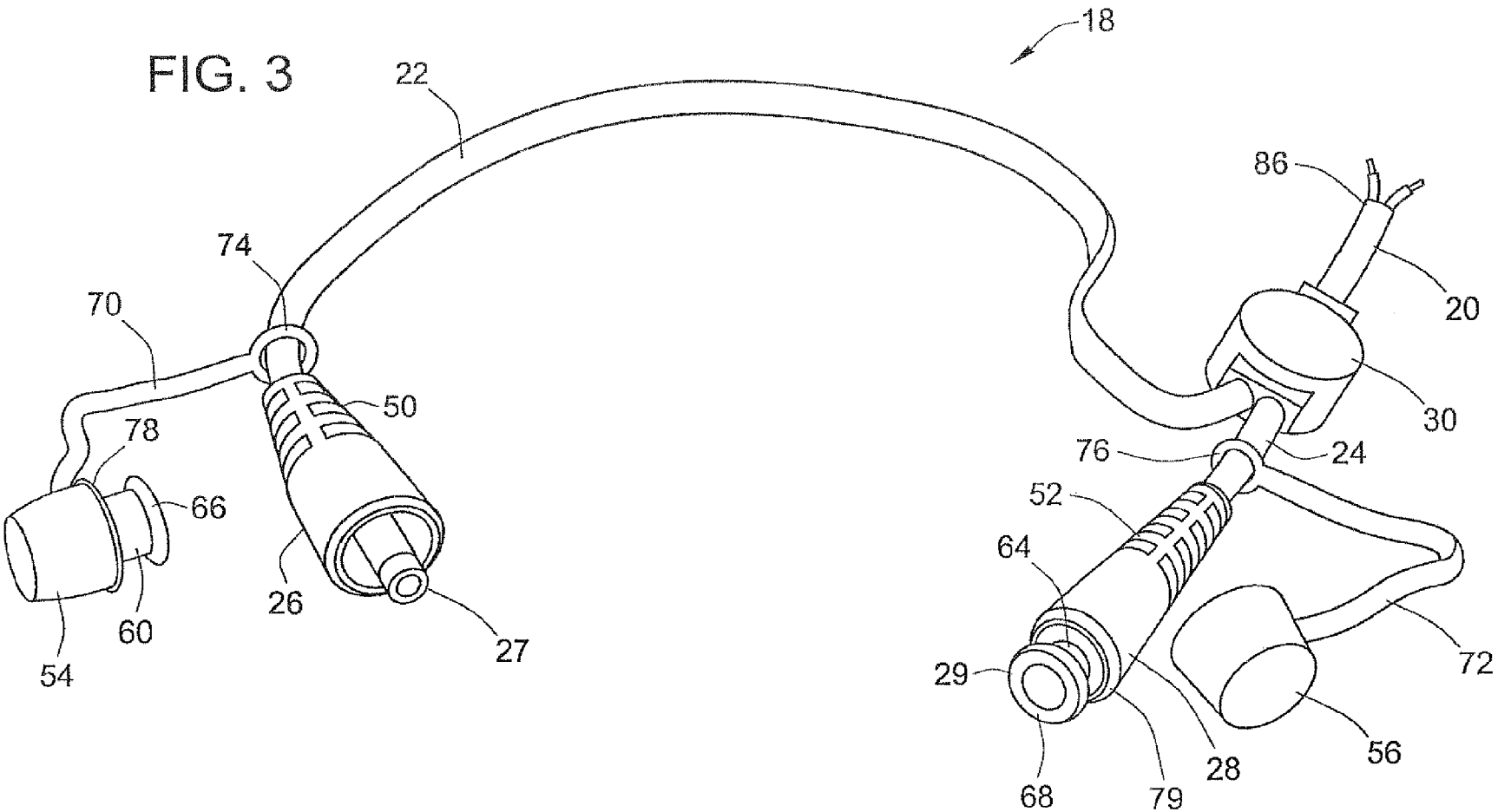
FIG. 3 is a perspective view of the embodiment of a modular connection cable illustrated in FIG. 1, but shown with a longer cable portion leading to the male connector.

Generally, as illustrated in FIG. 3, a cable segment 22, 24 of a connector cable 18 of this embodiment may terminate with a male 26 or female 28 connector plug, according to the present invention. Each male or female connector plug 26, 28 may include a respective male or female electrical connector terminal encased in a molded exterior of an insulating material. In an embodiment of the invention, the electrical connector terminal encased within the male connector plug 26 may be a standardized male DC power connector plug 27, partially extending from the male connector plug 26. The female connector plug 28 of this embodiment may include a standardized DC power socket (not shown) selected to mate with the male DC power plug 27 encased within the male connector plug 26. The female connector plug 28 may include an opening 29 shaped and configured to receive the DC power plug 27 of the male connector plug 26 when the two are connected, such that the DC power plug 27 engages the DC power socket within the female connector plug 28. As a result, electrical current can flow through the engaged male and female connector plugs 26, 28.

To ensure proper connectivity between male and female connector plugs 26, 28, each connector plug 26, 28, may be marked with the respective universal male or female symbol. The symbol may embossed or molded into the body of the connector plug 26, 28. Alternately, and in keeping with the inventive scope, the respective male or female universal symbol ("♂" or "♀")

may be painted, stamped, or otherwise applied to the respective connector plug 26, 28. In other embodiments, connector cables may be configured such that male connector plugs 26 function solely as power outputs, and female connector plugs 28 function solely as power inputs. Of course, in keeping with the inventive scope, various types of mating connector plugs may be utilized, and both male and female connector plugs may be configured to function solely as power inputs or outputs to facilitate the plug-and-play utility of the system, by providing for simple connections and preventing false connections.

Additionally, the connector plugs 26, 28 may include arrows embossed, painted, or otherwise applied thereto, to provide a visual or tactile indicator of the direction of current flow. In other embodiments, the male and female connector plugs 26, 28 may be color-coded to provide a quickly-identifiable indicator of input or output designation. For example, in one embodiment, the male connector plugs 26 may be formed of a black material, while the female connector plugs 28 are formed of a gray material. Of course, in keeping with the inventive scope, any color scheme may be used to color-code the connector plugs.

During manufacture of a connector cable according to the present invention, the standardized connector terminals inside the connector plugs 26, 28 may be connected to the insulated wires 32, 34 of the cable 20 before encasing the connector terminals within the plug 22, 24. The connections between the standardized terminals and the insulated wires 32, 34 within the plugs 26, 28 may be configured to maintain consistent polarity between a solar power source and a device that requires power along the length of one or more modular connector cables constructed in accordance with the present invention. The connection of standardized male or female electrical terminals to the ends of insulated wires that constitute a cable, so as to maintain consistent polarity between the cable ends is generally known to one of skill in the art.

Each connector plug 26, 28 of the present invention may include a ribbed portion 50, 52 at its base that not only provides flexibility to the cable, but also provides a tactile gripping surface. Each ribbed portion 50, 52 surrounds the insulated end of the cable length 22, 24 to which it is attached, providing flat disks of plastic that are spaced apart to provide flexibility to the connector plug 26, 28 attachment at the cable lengths 22, 24. The ribbed portions 50, 52, however, are generally more resistant to flexing than the cable lengths 22, 24, and thus reduce cable stress by preventing the cable lengths 22, 24 from excessively bending under load. In this way, the ribbed portions 50, 52 flex with the cable lengths 22, 24 so as to reduce stress in the cable length 22, 24 when the cable length 22, 24 is bent in the vicinity of the connector plug 26, 28. The ribbed portions 50, 52 also provide a secure gripping surface even after exposure to slippery substances such as oil.

To protect the electrical terminals encased within the connector plugs 26, 28, the connector cable of an embodiment may include connector plug caps 54, 56, as illustrated in FIG. 1. Each cap 54, 56 may be configured to exactly mate with the end of its respective male or female connector plug 26, 28. For example, the connector cap 54, configured to seal the male connector plug 26, may include an interior 58 shaped to receive the standardized male DC power plug 27, as illustrated in FIG. 1. The connector cap 54 may further include a flanged ring 60 that extends from the cap and snugly fits into a mating surface (not shown) on the interior of the connector plug 26. Similarly, the cap 56 configured to seal the female 28 connector plug 28 may be configured with an interior 62 shaped to receive a flanged ring 64 that extends from the female 28 connector plug.

Figure 2:
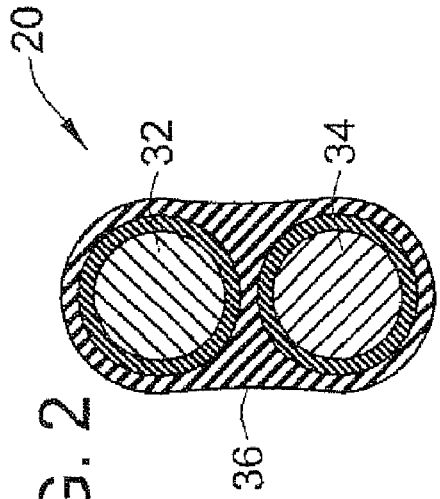
FIG. 2 is a sectional view, taken along line 2-2, of the cable of FIG. 1.

As illustrated in FIG. 2, to attach each cap 54, 56 to the cable length 22, 24 connected to its respective connector 26, 28, a cap lead 70, 72 may extend from each cap 54, 56. Each cap lead 70, 72 preferably terminates in a cap lead ring 74, 76 that encircles the respective cable length 22, 24, thus securing the cap 54, 56 to the connector cable 18. The cable lengths 22, 24 may be inserted through their respective cap lead rings 74, 76 during assembly of the connector cable 18, before the cable length 22, 24 is attached to its respective connector plug 26, 28. Each cap lead ring 74, 76 may have a larger inner diameter than its respective cable lengths 22, 24, to allow the caps 54, 56 to be moved away from the connector plugs 26, 28 when the caps 54, 56 are not engaged with their respective connector plugs 26, 28. The caps 54, 56 are thus less likely to interfere in the connection of mating connector plugs 26, 28.

To provide a watertight seal that is also resistant to dust and other substances harmful to electrical terminals, each protruding flanged ring 60, 64 of a male connector plug cap 54 or a female connector plug 28 may include a sealing ring 78, 79, such as a rubber o-ring, that encircles its respective flanged ring 60, 64. The sealing rings 78, 79 may be of a smaller inner diameter than the outer diameter of the flanges 66, 68 so that the flanges 66, 68 retain the sealing rings on the flanged rings 60, 64. The sealing rings 78, 79 thus provide a seal between the connector plugs 26, 28 and their respective caps 54, 56, when the caps 54, 56 are engaged with their respective plugs 26, 28 and the sealing rings 78, 79 are compressed between adjacent surfaces. Moreover, when the male and female connector plugs 26, 28 of modular cables constructed in accordance with the present invention are engaged with each other, the flanged ring 64 of the female 28 connector plug is received by a mating surface within the body of the male 26 connector plug thus ensuring a tight fit. In this case, the sealing ring 79 disposed on the female connector plug 28 provides for a watertight seal between the two mating connector plugs 26, 28. The sealing ring disposed on the flanged ring 64 of each female connector plug 28, and held in place by the flange 68, thus ensures that a sealing ring is disposed between male and female connector plugs 26, 28 of the invention, each time a connection is made between them.

In the embodiment of FIG. 1, the junction ends 80, 82, 84 of the cable lengths 20, 22, 24 are received by a junction 30. The junction forms a "Y"-shape, with current flowing into the junction 30 from the hard-wire end 86 of cable length 20. The current is then split to plugs 26, 28, via cable lengths 22, 24. In this embodiment, the female connector plug 28 may receive a current input from another solar power source. The junction 82 facilitates connections of consistent polarity between the cable lengths 20, 22, 24, as is generally known to one of ordinary skill in the art. Thus, for example, if a solar power source is connected to the hard-wiring end 86 or the female connector plug 28 of the connector cable 18 of this embodiment, current can flow to the male connector plug 26 for output to a device or another connector cable embodiment of the present invention.

The junction 30 of this embodiment may be molded or otherwise formed of an insulating material as is known in the art. The junction 30 may include a gripping surface 88 that provides for a secure grip of the junction 30, particularly after it has been exposed to a slippery substance, such as oil. The junction 30, may thus provide a secure, convenient, and comfortable means for gripping a connector cable of the present invention. This gripping surface also allows for retaining the cable in one hand while manipulating connector ends or extending the cable.

According to the embodiment of the invention illustrated in FIG. 1, the hard-wiring end 86 of a connector cable 18 may be fixed to a solar power source (not shown) including a single solar panel or a plurality of solar panels connected in series or in parallel. As the solar power source connected at 86 generates current, the current flows through the cable length 20 toward the junction 30. If the male connector plug 26 is connected to a device, either directly, or through additional connection cable embodiments of the present invention, electrical current of consistent polarity will flow from the solar power source to the device.

This embodiment of the invention also provides for connection of multiple solar panels in parallel, thus allowing for changes in the current output at fixed voltage, up to the maximum current rating of the connector cable. Specifically, junction 30 may be configured, as is known to one of skill in the art, such that the female input plug 28 of the connector cable 18, which is also hard-wired to a first solar power source, may receive the male output plug of another solar power source, thus connecting the solar power sources in parallel. The male output plug 26 of the connector cable 18 attached to the first solar power source may then be connected to a device, thus providing a current equal to the sum of the currents, at a constant voltage, of the power sources thus connected in parallel. Accordingly, solar power sources may be easily added or removed to meet the current demand of a device, simply by connecting or disconnecting solar power sources by using connector cables constructed in accordance with the present invention.

Additionally, the construction of the connector cables attached to each solar power source ensures that the polarity of the male and female connector plugs of each connector cable is compatible. It is to be appreciated that this embodiment is not limited to the connection of two solar panels in parallel. To the contrary, 3, 4, 5, 6, 7, or more solar panels may be connected in parallel to power a device according to this invention, limited only by the electrical properties, particularly the maximum current rating of the cable segments, the standardized connector terminals, and the junction.

Figure 4:
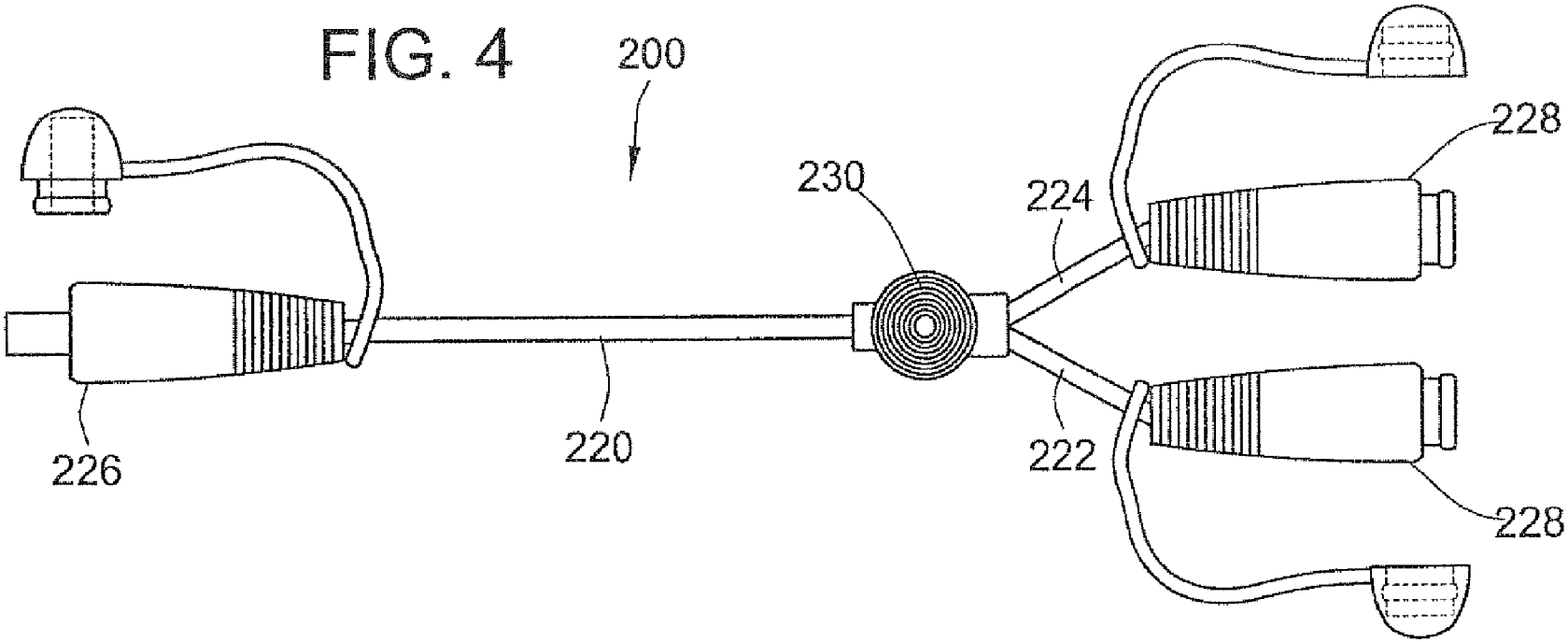
FIG. 4 is a plan view of an embodiment of an alternate modular connection cable of a solar panel connection system constructed in accordance with teachings of the invention, the cable of this embodiment providing for multiple power inputs and a single power output.
Figure 5:
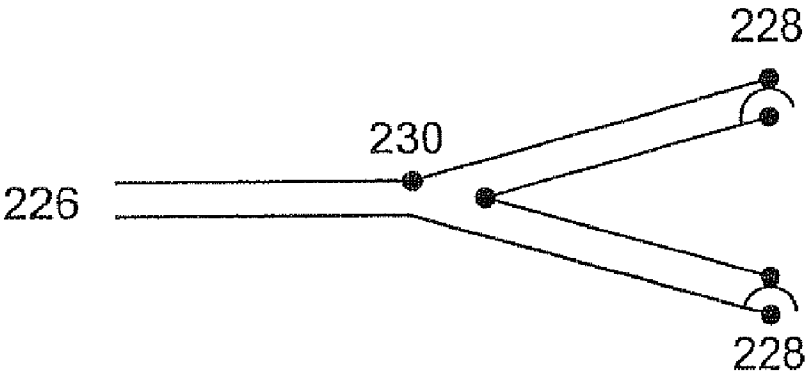
FIG. 5 is a schematic view of the electrical circuit of the connection cable embodiment of FIG. 4.

Another embodiment of the invention, illustrated in FIG. 4, allows the connection of multiple solar power sources in series. The connector cable 200 of this embodiment may include 3 cable segments 220, 222, 224, extending from a junction 230, to form a "Y"-shape. One cable segment 220 extends from the junction 230 and terminates with a male output connector plug 226. The other cable segments 222, 224 may terminate with female connector input plugs 228 that have electrically inverted leads so that power inputs connected to them via mating male connector plugs become connected in series. This type of series arrangement of power sources is known to those of skill in the art, and is schematically illustrated in FIG. 5.

As a result of the series connection provided by this embodiment, the voltage output at the male connector output plug 226 is the sum of the input voltages from the solar power sources, at a constant current. As a result, the total voltage at the male output connector plug 226 may be increased or decreased to meet demand, simply by connecting or disconnecting solar power sources to and from the connector cable of this embodiment. Of course, it is to be appreciated that this embodiment of the invention is not limited to 2 power inputs arranged in series. To the contrary, 3, 4, 5, 6, 7, or more input connector plugs may be connected to the junction 230 with a single output, resulting in a plurality of solar power sourced connected in series. The number of inputs is limited only by the physical limitations of the junction 230, and the maximum voltage ratings of the cable segments, standardized connector terminals, and junctions.

Figure 6:
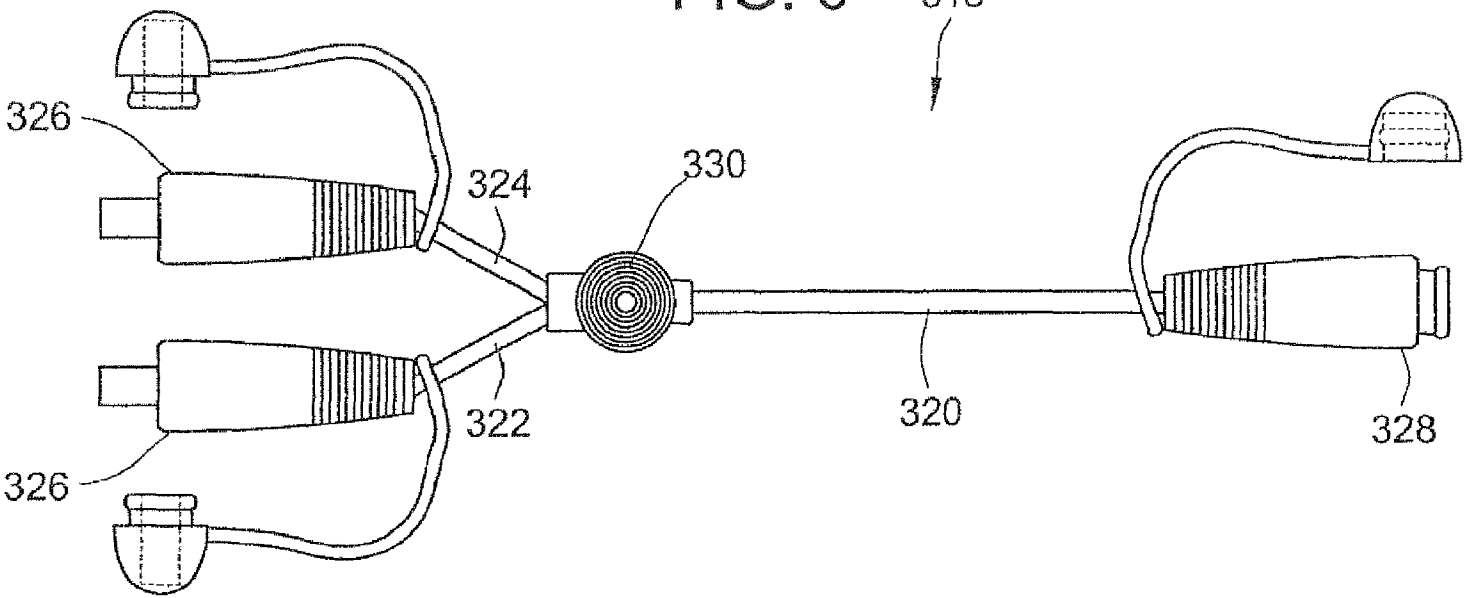
FIG. 6 is a plan view of an embodiment of an alternate modular connection cable of a solar panel connection system constructed in accordance with teachings of the invention, the cable of this embodiment providing for a single power input and multiple power outputs.

To permit the connection of two loads or devices to a single solar power output, another embodiment of a connector cable 318 may include three cable segments 320, 322, 324 extending from ajunction 330, as illustrated, for example, in FIG. 6. Two of the cable segments 322, 324 extending from the junction 330 may terminate with male connector plugs 326 functioning as power outputs, and a third cable segment 320 extending from the junction 330 may terminate with a female connector plug 328 functioning as a power input. The electrical connections within the junction 330 are configured, as is known to one of ordinary skill in the art, such that the current flowing into female input connector plug 328 may feed two loads or devices simultaneously. While this embodiment is configured to supply power to two loads or devices simultaneously, it will be appreciated that an alternate embodiment of the invention could be provided to supply three or more loads simultaneously.

Figure 7:
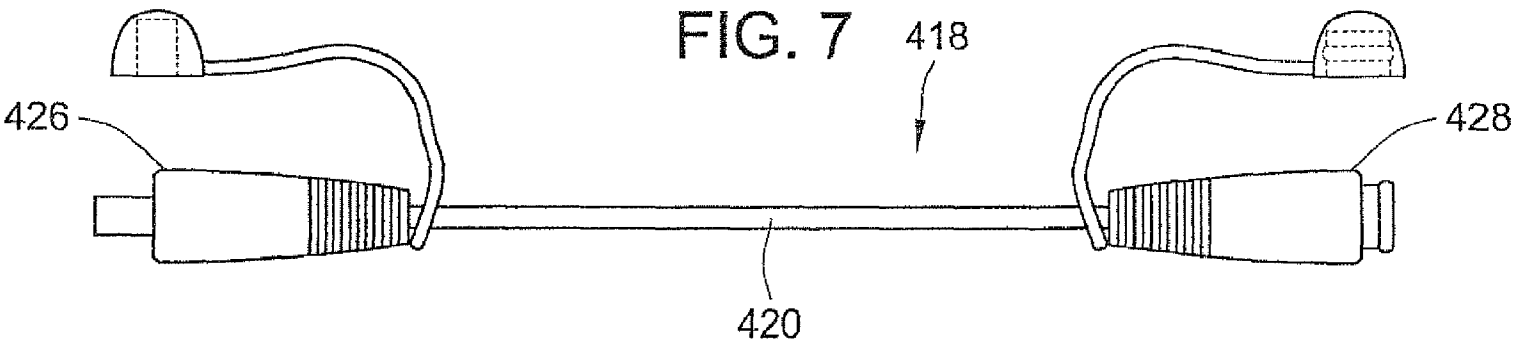
FIG. 7 is a plan view of an embodiment of an alternate modular connection cable of a solar panel connection system constructed in accordance with teachings of the invention, the cable of this embodiment providing for a single power input and a single power output, thus acting as an extension.

In another embodiment of the present invention, a connector cable may be configured as an extension cable 418, as illustrated in FIG. 7. This embodiment functions to increase the distance between a solar power source and a device or load, or between other connections. For example, it may be advantageous to optimally position the solar power source with respect to sunlight, while allowing the device to be used in another location where there is little sunlight or none at all. In this embodiment, opposite ends of a cable segment 420 are connected to male 426 and female 428 connector plugs, respectively. The female connector plug 428 of this embodiment functions as a power input that receives current, ultimately from a solar power source. The current then flows through cable segment 420, to a male connector plug 426. The male connector plug 426 may be connected to a device either directly, or through another connector cable configured according to the system of the present invention, via, for example, a standardized DC power socket or mating female connector socket, respectively.

Figure 8:
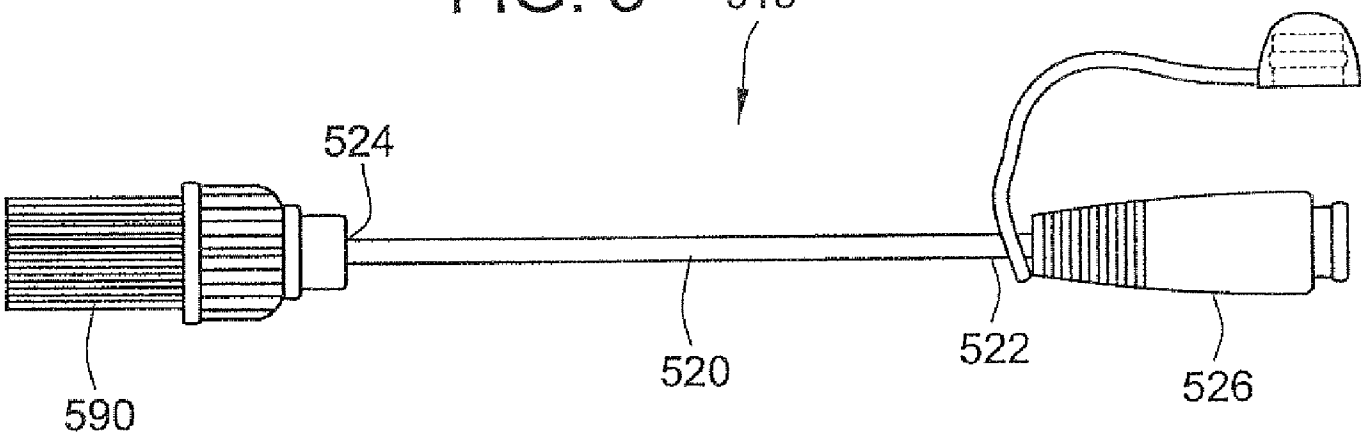
FIG. 8 is a plan view of an embodiment of an alternate modular connection cable of a solar panel connection system constructed in accordance with teachings of the invention, the cable of this embodiment providing for power output via a universal power socket.
Figure 9:
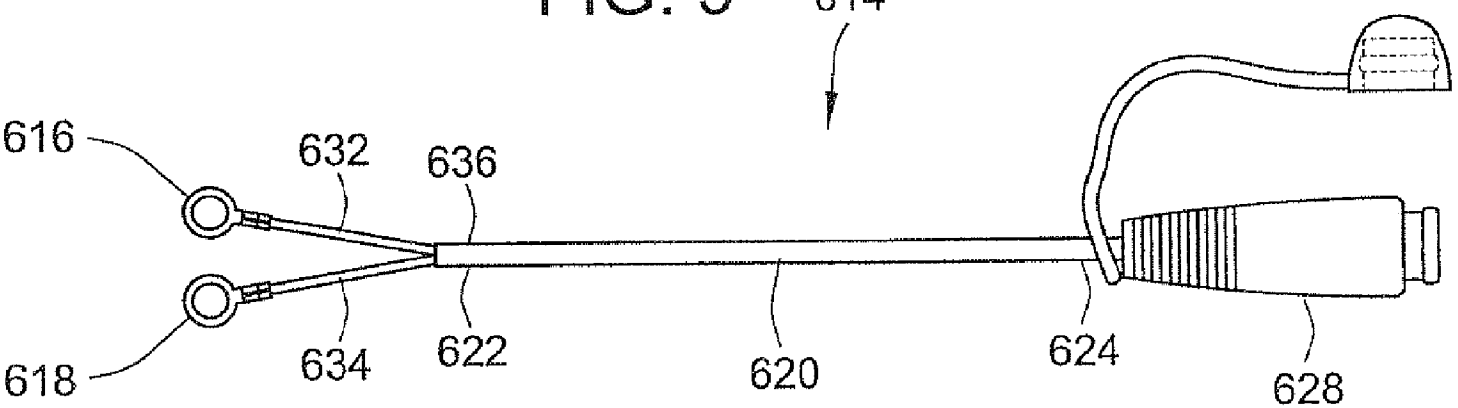
FIG. 9 is a plan view of an embodiment of an alternate modular connection cable of a solar panel connection system constructed in accordance with teachings of the invention, the cable of this embodiment providing for ring wire connection to a device requiring power.

In another embodiment of the present invention, a connector cable may be configured to provide power to a device via a universal output plug or socket. In the embodiment of FIG. 8, a connector cable 518 includes a cable segment 520 with a first end 522 and a second end 524. The first end 522 is connected to a female connector plug 526 configured as a power input that receives power from a solar power source via a mating male connector plug. The second end 524 is connected to a universal female cigarette lighter adapter ("CLA") socket that functions as a power output, for devices configured to receive power via universal male CLA plugs. The method of connecting a CLA plug to an end of a length of cable to maintain consistent polarity with a power source connected to the other end is generally known to those of skill in the art. The connection cable 518 of this embodiment thus provides a conduit for current flow from a solar power source to a device configured to draw current from a CLA plug. This is advantageous, as many types of consumer devices such as 12 volt inverters, consumer electronic chargers, compressors, and other devices are configured with CLA plugs. It is to be understood that, in keeping with the inventive scope, the connection cable 518 of this embodiment may be configured with many other types of standard electrical connectors other than CLA sockets.

In still another embodiment according to the system of the present invention, a connector cable 614 may be configured to provide power from a solar power source to a device via ring terminals 616, 618. In this embodiment, illustrated in FIG. 9, a connector cable 614 includes a cable segment 620 with two ends 622, 624. One end 624 is connected to a female connector plug 628, configured to receive power input from a mating male connector plug further connected directly or indirectly to a solar power source. The other end 622 is configured such that insulated wires 632, 634 extend from the cable sheath 636. Each insulated wire terminates with a ring terminal 616, 618 crimped onto the end of the wire 632, 634. The ring terminals 616, 618 may be connected to a device via battery terminals provided on the device. Alternately, the ring terminals 606, 618 provide a versatile means of attaching the connector cable 614 of this embodiment to other devices with separate positive and negative DC terminals.

The connector cable 614 of this embodiment may be configured for a particular polarity, as is known to those of skill in the art. Further, the insulated wires 632, 634 of this embodiment may be color-coded according to standard polarity designations (red for positive, black for negative). The ring terminals 616, 618 of this embodiment may also be configured to include embossed or stamped designations of polarity. This embodiment is particularly advantageous from a safety perspective. It allows many devices that ordinarily utilize battery power to utilize current from solar power sources. Risks inherent in the use of batteries include short circuits, that may lead to damaging explosions, fire, and burns to bystanders. This embodiment of the invention increases safety by eliminating the risks posed by batteries.

It is to be appreciated that, in accordance with the present invention, any combination of modular connector cables constructed in accordance with the system of the present invention may be utilized to provide power from one or more solar power sources to one or more devices requiring it. Thus, the invention provides a safe efficient and weatherproof system for such uses.

While this invention has been described with an emphasis upon preferred embodiments, it will be obvious to those of ordinary skill in the art that variations of the preferred embodiments may be used, and it is intended that the invention can be practiced otherwise than as specifically described herein. Moreover, while the various cables of the embodiments have been illustrated with certain lengths, it will be appreciated that the cable may have alternate, either shorter or longer, lengths, as appropriate. Accordingly, this invention includes all modifications encompassed within the spirit and scope of the invention as defined by the following claims:

The invention claimed is:

1. A dual-core modular electrical cable system for facilitating connection of at least two photovoltaic cells in series and for connection to a load, comprising first dual-core cable segments, each of said first dual-core cable segments having a first end provided with a first coaxial power connector adapted for being electrically detachably connected to one of said photovoltaic cells via a corresponding first mating coaxial power connector to receive power therefrom;

a second dual-core cable segment having a second end provided with a second coaxial power connector adapted for being electrically detachably connected to said load via a corresponding second mating coaxial power connector; and a junction for aggregating said first dual-core cable segments and said second dual-core cable segment to electrically interconnect said at least two photovoltaic cells in series and to further connect said at least two photovoltaic cells to said load.

2. The dual-core modular electrical cable system according to claim 1, wherein one of said first ends or said second end is of the male type coaxial power connector and the other one of said first said at least one of said first ends is of the female type coaxial power connector.

3. The dual-core modular electrical cable system according to claim 1, wherein said first ends and said second end are color-coded.

4. The dual-core modular electrical cable system according to claim 1, wherein said first ends and said second end are marked with arrows indicating the direction of flow of energy.

5. The dual-core modular electrical cable system according to claim 1, wherein said first ends and said second end further provide with gripping grooves.

6. The dual-core modular electrical cable system according to claim 1, wherein each of said first ends and said second end further comprises a cap, including at least one compressible ring on said cap or the plug in order to hermetically seal the resulting joint when said each of first ends and said second end is capped.

7. A kit for interconnecting plurality of photovoltaic cells to at least one load, comprising:

at least one dual-core modular electrical cable system for facilitating a connection of at least two of said photovoltaic cells in parallel and for connection to said load, comprising first dual-core cable segments, each of said first dual-core cable segments having a first end provided with a first coaxial power connector adapted for being electrically detachably connected to one of said photovoltaic cells via a corresponding first mating coaxial power connector;

a second dual-core cable segment having a second end provided with a second coaxial power connector adapted for being electrically detachably connected to said load via a corresponding second mating coaxial power connector;

a junction for electrically interconnecting said at least two of said photovoltaic cells in parallel and connecting further to said load; and at least one dual-core modular electrical cable system for facilitating a connection of at least two of said photovoltaic cells in series and for connection to said load, comprising:

first dual-core cabling segments, each of said first dual-core cabling segments having a first end provided with a first coaxial power connector adapted to be electrically detachably connected to one of said photovoltaic cells via a corresponding first mating coaxial power connector;

a second cabling segment having a second end provided with a second coaxial power connector adapted to be electrically detachably connected to said load via a corresponding second mating coaxial power connector; and a junction for electrically interconnecting said at least two of said photovoltaic cells connected via said first cabling segments in series and connecting further to said load through said second cabling segment.

8. The kit according to claim 7, wherein one of said first coaxial power connector and said second coaxial power connector is of the male type and the other thereof is of the female type.

9. The kit according to claim 7, wherein said first coaxial power connector and said second coaxial connector are color-coded.

10. The kit according to claim 7, wherein said first coaxial power connector and said second coaxial power connector are marked with arrows indicating the direction of flow of energy.

11. The kit according to claim 7, wherein each of said first coaxial power connectors and said second coaxial power connectors is further provided with gripping grooves.

12. The kit according to claim 7, wherein each of said first coaxial power connectors and said second coaxial power connectors further comprises a caps, said caps including at least one compressible ring on the cap or the said each of said first coaxial power connectors and said second coaxial power connectors in order to hermetically seal the resulting joint when the plug is capped.

* * * * *